United States Patent [19]

Lipschutz

[11] 4,074,551

[45] Feb. 21, 1978

[54] CYLINDER LOCKS HAVING PLATES

[75] Inventor: Paul Lipschutz, Croissy, France

[73] Assignee: Neiman S. A., Courbevoie, France

[21] Appl. No.: 723,000

[22] Filed: Sept. 15, 1976

Related U.S. Application Data

[63] Continuation of Ser. No. 593,137, July 3, 1975, abandoned.

[51] Int. Cl.[2] ..... E05B 29/02

[52] U.S. Cl. ..... 70/364 R; 70/377; 70/417

[58] Field of Search ..... 70/364 R, 377, 417

[56] References Cited

U.S. PATENT DOCUMENTS

| | | | |
|---|---|---|---|
| 1,725,557 | 8/1929 | Baird | 70/377 |
| 1,960,263 | 5/1934 | Fitzgerald | 70/364 R |
| 1,964,963 | 7/1934 | Shinn | 70/364 R |
| 2,094,716 | 10/1937 | Palmer | 70/377 |
| 2,667,785 | 2/1954 | Opocensky | 70/377 |
| 3,499,209 | 3/1970 | Laviana | 70/417 |
| 3,854,311 | 12/1974 | Mercurio | 70/377 |
| 3,969,915 | 7/1976 | Droske | 70/377 |

FOREIGN PATENT DOCUMENTS

| | | | |
|---|---|---|---|
| 1,527,014 | 4/1968 | France | 70/377 |
| 1,471,250 | 1/1967 | France | 70/377 |
| 272,782 | 1/1951 | Switzerland | 70/364 R |

*Primary Examiner*—Robert L. Wolfe
*Attorney, Agent, or Firm*—Nolte and Nolte

[57] ABSTRACT

A cylinder lock which has a cylindrical barrel provided with radially slidable plates elastically biased to project from said barrel into at least one groove in the body of the lock. Said plates project slightly from the barrel in the position to which said plates are returned inside the barrel by the key of the lock, whereby picking of the lock is made more difficult.

11 Claims, 6 Drawing Figures

CYLINDER LOCKS HAVING PLATES

This is a continuation of application Ser. No. 593,137 filed July 3, 1975 and now abandoned.

The present invention relates to cylinder locks having locking means constituted by tumblers in the form of blanked metal plates or wafers radially mounted in an element, or barrel, which is rotatable in a stator when a key inserted in the barrel has withdrawn the plates which no longer prevent the barrel from moving with respect to the stator.

It is known that locks of this type are, for a given number of locking members, much more easily "picked" than cylinder locks having pins. Indeed, in order to slide, the plates must have a certain lateral play and consequently by a partial rotation, it is possible to put them successively sufficiently on the skew to release the barrel. This picking method is termed the HOBB method.

An object of the present invention is to greatly increase the resistance of locks having plates to picking by the HOBB method while prolonging the mechanical resistance of the lock.

According to the invention there is provided a lock having a cylindrical barrel provided with tumblers in the form of radially slidable plates biased elastically to project from said barrel into at least one groove in the body of the lock, wherein said plates project slightly from said barrel in the position to which said plates are withdrawn into the barrel by the key of the lock.

The projection of the plates is such that they do not prevent the rotation of the barrel when the key is inserted, owing to the clearance between the barrel and the fixed body or stator of the lock. On the other hand, putting the plates on the skew does not permit releasing the barrel, unless of course each one of the plates is practically in its withdrawn position inside the barrel.

Preferably, the projection of a plate is constituted by an eccentric circular portion of the circular peripheral profile centered on the centre of the plate, said eccentric portion being connected to said circular profile.

In one embodiment, the invention permits still further reducing the play of the plate in the receiving groove of the stator and furthermore improving the performance of this part of the lock. In this embodiment, the grooves of the body of the lock are covered with a attached layer of a material which is more resistant to friction than the rest of the body. Preferably, the layer is constituted by a sheet metal which is blanked out and folded and maintained in the groove of the body of the lock. The lock body can thus be made from a less resistant material, for example plastics material.

In an embodiment providing an increased safety, the invention provides for the association of the plates in groups of at least two identical plates which are side-by-side and slidable in a common slot of the barrel. In this embodiment, the offset of one plate of a group prevents rotation of the barrel and this prevents a picking of the lock by an oblique displacement of the plates.

The invention will be understood better from the ensuing description with reference to the accompanying drawing, in which.

Figure 1:
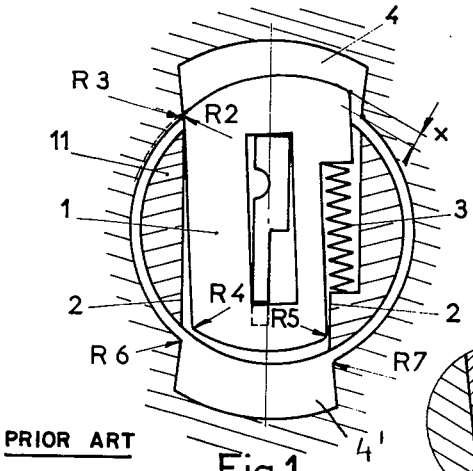
PRIOR ART Fig.1
FIG. 1 is a cross-sectional view of a conventional cylinder lock having plates and with an incorrectly coded key inserted therein.

In a conventional cylinder lock having tumblers in the form of plates (FIG. 1), a plurality of radially extending passageways or slots 2 are formed in a barrel 11 and in each one a plate 1 is disposed for radial sliding movement. A lateral spring 3 biases the plate 1 towards a groove 4 in the lock body. As a result of the tolerances of manufacture and combinations of the key, the height "$x$" of the hooking of the plate in abutment (on the spring side) may be very small (0.1 to 0.3 mm), but it can still oppose any movement in the clockwise direction.

But, owing to the tilting produced by the spring 3, which exerts a lateral thrust with respect to the axis of the plate, the projecting height of the plate, on the side opposed to the hooking height "$x$", may become nil. Therefore, although it may not be possible to rotate the barrel in the clockwise direction, nothing opposes its rotation in the counterclockwise direction.

Figure 2:
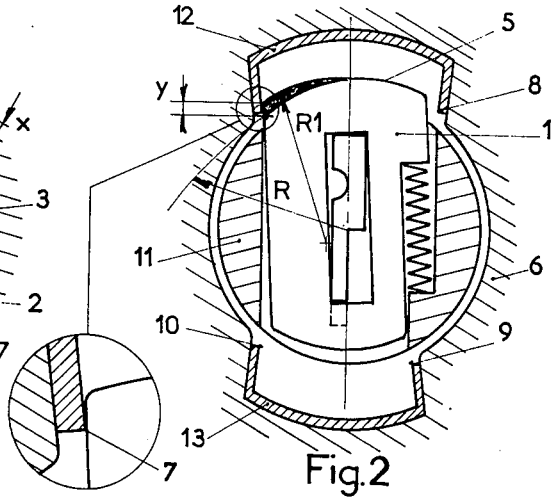
FIG. 2 is similar to FIG. 1 of a cylinder lock having plates according to one embodiment of the invention with, in the inset, an enlarged view of the corner between the plate and barrel and again with an incorrectly coded key inserted therein.

The present invention remedies this failure of the conventional plate tumbler by modifying the upper contour or outline of the plate 1 as shown in FIG. 2 by giving the plate a radial projection in the corresponding corner. This projection compensates for the insufficient locking and ensures a locking in both directions. In order to effectively achieve this compensation, it is preferable, in order to avoid adversely affecting ease of rotation, to give to this projection a profile in the form of an arc of a circle having a radius $R_1$ whose centre is offset with respect to the axis of the plate. This arc may be connected with the arc of radius R which constitutes the normal profile 5 of the plate.

The stators and rotors of cylinder locks having plates are easily pressure moulded, whereas the plates are blanked out and have their burrs removed in a tumbling barrel. Consequently, it is practically impossible to obtain sharp corners on both the plates and moulded parts; rounded corners having radii such as $R_2$, $R_4$, $R_5$ (FIG. 4) may therefore contribute when trying to rotate the barrel, to facilitate the shifting of the plates toward the centre by decreasing or completely eliminating the hooking of the plates. In addition to the unavoidable existence of these radii, the material from which the plates are blanked and the hardening which results from their machining, render these plates much harder than the part in which they are received, and, after a certain number of rotations of the lock, grooves are formed in the stator which facilitate the release of the lock with keys other than that which is designed for the lock.

In order to overcome these drawbacks, the invention provides for reinforcing the body in the region of the grooves 4, 4' by inserts 12 and 13 of blanked steel. In this way sharp corners 7, 8, 9 and 10 are obtained and the hardness is sufficient to prevent any formation of grooves.

Another drawback of cylinder locks having plates is the ease with which it is possible, by axially displacing a key, to create a large number of different combinations which thus make it possible to open several combination locks with a single key.

Figure 3:
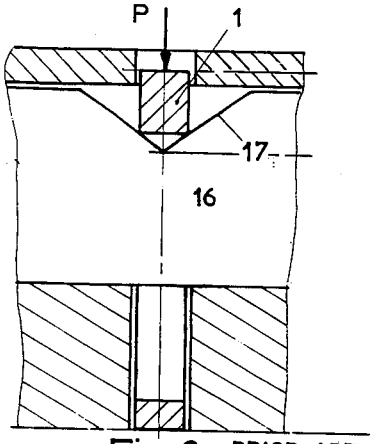
Fig. 3 PRIOR ART
FIG. 3 is a longitudinal sectional view of a conventional lock.
Figure 4:
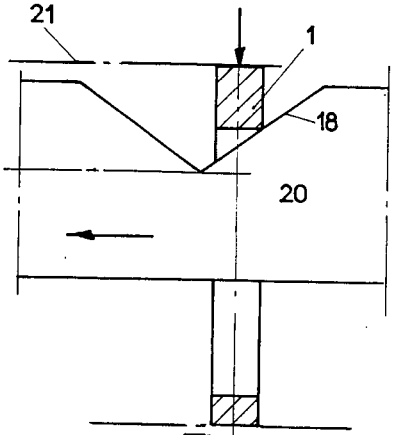
Fig.4 PRIOR ART
FIG. 4 is similar to FIG. 3, the key being in a different position.
Figure 5:
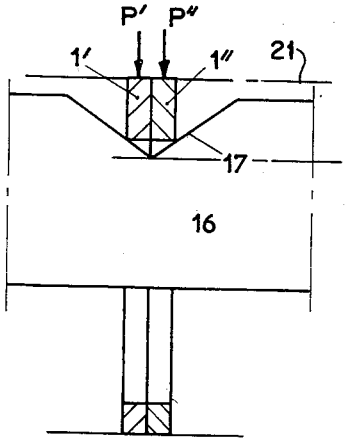
FIG. 5 and FIG. 6 are similar to FIGS. 3 and 4 respectively in respect of a lock according to one embodiment of the invention.

This possibility is illustrated in FIGS. 3 and 4.

The plate 1 biased by a pressure P, such as that exerted by a spring is urged back into the withdrawn position by the key 16, the inner profile of the plate bearing against the notch 17 whose depth is chosen to obtain exactly this position (FIG. 3). It is clear that another key 20 may ensure the same withdrawn position of the plate 1 in a notch 18 of different depth if the key is displaced axially: the right edge of the inner profile of the plate bears this time on the slope of said notch 18.

In order to overcome these drawbacks in the illustrated embodiment, the single plate is replaced by two identical plates 1' and 1'' which are in adjacent relation and slide in the same slot of the barrel. Thus, when the two plates 1' and 1'' are on the axis of the notch 17, their tops are in alignment and tangent to the generatrix 21. The double plate 1', 1'' is in its withdrawn position inside the barrel.

Figure 6:
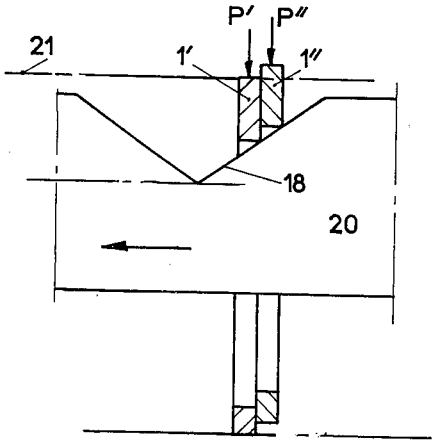

On the other hand, by axially displacing the key 20 and presenting a notch which does not conform to the code, one of the twin plates 1', 1'' is made to align with the generatrix 21 but the other plate 1'' is offset with respect to this generatrix (FIG. 6). Therefore, the presence of the second plate 1'' prevents any opening of the lock which would otherwise be possible by shifting the key 20 axially.

What is claimed is:

1. A cylinder lock having a cylindrical barrel provided with radially slidable plates elastically biased to project from said barrel into at least one groove in the body of the lock, wherein one radial end portion of each said plates projects slightly from the barrel and the other of the radial end portions of each said plates is disposed on the cylindrical surface of said barrel, in the position to which said plates are returned inside the barrel by the insertion of a correctly coded key for the lock to free the lock, said one radial end portion being constituted as means abutting a surface defining said groove to resist picking.

2. A lock as claimed in claim 1 wherein said one radial end portion is defined by a part of the plate having a circular peripheral profile, adjacent regions of said plate also having a circular peripheral profile and being centered on the center of the plate, said one radial end portion being eccentric to said adjacent portion of the plate and connected thereto.

3. A lock as claimed in claim 1, wherein the grooves in the body of the lock are covered with an attached layer of a material which is more resistant to friction than the rest of the body.

4. A lock as claimed in claim 1, wherein the layer is constituted by a blanked and folded sheet of metal maintained in the groove of the body of the lock.

5. A lock as claimed in claim 1, wherein the plates are associated in groups of at least two identical side-by-side plates which are slidable in a common slot of the barrel.

6. In a lock of the kind having a stator, a rotatable barrel, a plurality of locking plates rotatable with and radially slidable in said barrel and resilient means biasing the plates into locking engagement with the stator to prevent rotation of the barrel, said plates including coding means cooperating with a correspondingly coded key to be moved out of engagement with said stator to an unlocked position upon the insertion of such a key, to free the barrel for rotation, the barrel being received with clearance within a cylindrical passage of the stator, the improvement comprising a locking plate of a length such that one radial end of said plate is disposed in the clearance between the barrel and the stator and the other radial end of the plate is disposed at the circumference of the barrel when the plate is in said unlocked position.

7. Apparatus as claimed in claim 6 wherein said locking plate comprises a pair of parallel side edges and a pair of opposite, curved end edges, portions of said end edges being circular, having a common center and a curvature equal to the curvature of said barrel and another portion of at least one of said end edges at a junction of said at least one end edge and one of said side edges being disposed outwardly of a circle upon which said portions of said end edges lie.

8. Apparatus as claimed in claim 6 wherein said locking plates are received within recesses of said stator in a locked position thereof and wherein said recesses have a reinforcing insert of a material harder than the material of the remainder of the stator.

9. Apparatus as claimed in claim 8 wherein said insert is of sheet metal.

10. Apparatus as claimed in claim 6 wherein said locking plates are disposed in generally radial passages of said barrel to be radially sidable therein and wherein two identical locking plates are disposed in such a passage.

11. A lock of the kind comprising a stator having a generally cylindrical passage therein, a cylindrical barrel mounted for rotation in said passage of said stator, a plurality of axially spaced radially extending passageways in said barrel, generally flat locking plate means disposed in said passageways and radially slidable therein, a pair of diametrically opposed recesses formed in said stator and opening into said passage of said stator, said locking plate means of said barrel, in a locked position of said barrel, projecting into one of said recesses to prevent rotation of said barrel, said locking plate means comprising a pair of identical locking plates disposed in a single passageway, said locking plates having coding means cooperating with a correspondingly coded key to be moved out of engagement with said recess of said stator upon the insertion of such a key.

* * * * *